US010851501B2

(12) United States Patent
De Rivas

(10) Patent No.: US 10,851,501 B2
(45) Date of Patent: Dec. 1, 2020

(54) EASILY RENOVATED EXPANSION JOINT FOR A CONCRETE SLAB FORMWORK SYSTEM

(71) Applicant: LYNKS, La Talaudiere (FR)

(72) Inventor: Arnaud De Rivas, La Talaudiere (FR)

(73) Assignee: LYNKS, La Talaudiere (FR)

( * ) Notice: Subject to any disclaimer, the term of this patent is extended or adjusted under 35 U.S.C. 154(b) by 0 days.

(21) Appl. No.: 16/614,917

(22) PCT Filed: May 23, 2017

(86) PCT No.: PCT/FR2017/051272
§ 371 (c)(1),
(2) Date: Nov. 19, 2019

(87) PCT Pub. No.: WO2018/215699
PCT Pub. Date: Nov. 29, 2018

(65) Prior Publication Data

US 2020/0190746 A1 Jun. 18, 2020

(51) Int. Cl.
*E01C 11/10* (2006.01)
*E01C 11/08* (2006.01)

(52) U.S. Cl.
CPC ..... *E01C 11/106* (2013.01); *E01C 11/08* (2013.01); *E04B 2103/02* (2013.01)

(58) Field of Classification Search
CPC ..... E01C 11/106; E01C 11/08; E04B 2103/02
See application file for complete search history.

(56) References Cited

U.S. PATENT DOCUMENTS 4,893,448 A 1/1990 McCormick
6,022,169 A * 2/2000 Kim ..... E01D 19/062 404/52

(Continued)

FOREIGN PATENT DOCUMENTS

DE 29901141 U1 5/1999
DE 20209995 U1 11/2002

(Continued)

OTHER PUBLICATIONS

English Translation of the Written Opinion for PCT/FR2017/051272 (5 pages) (dated 2019).*

(Continued)

*Primary Examiner* — Rodney Mintz
(74) *Attorney, Agent, or Firm* — Marshall, Gerstein & Borun LLP

(57) ABSTRACT

An expansion joint (1) for a concrete slab formwork system, said joint comprising first and second longitudinal elements (2, 3), arranged side-by-side in the same horizontal plane, and intended to each form an integral part with an upper and horizontal edge of a concrete slab, the first and second longitudinal elements (2, 3) comprise arrangements (5, 6, 7) opening on their upper horizontal walls and enabling at least a portion (2*a*, 3*a*) of each of the first and second longitudinal elements (2, 3) to be withdrawn for replacement thereof. The first longitudinal element (2) comprises a stack of three layers of material (2*a*, 2*b*, 2*c*), with an intermediate layer (2*b*) having a smaller width than that of the two other layers (2*a*, 2*c*) such that the first longitudinal element (2) has a U-shaped cross-section, and the second longitudinal element (3) comprises a stack of three complementary layers of material (3*a*, 3*b*, 3*c*), with an intermediate layer (3*b*) having a larger width than that of the two other layers (3*a*, 3*c*) so as (Continued)

to form a transverse projection that is able to fit in the recess of the U-shape of the first longitudinal element (2).

7 Claims, 3 Drawing Sheets

(56) References Cited

U.S. PATENT DOCUMENTS

| | | | | |
|---|---|---|---|---|
| 9,366,021 | B2 * | 6/2016 | Voet | E04B 1/38 |
| 10,077,533 | B2 * | 9/2018 | Meuwissen | E01C 11/14 |
| 10,253,508 | B2 * | 4/2019 | Gazzotti | E01C 11/126 |
| 10,323,359 | B2 * | 6/2019 | Meuwissen | D21H 27/30 |
| 10,711,410 | B2 * | 7/2020 | Meuwissen | E01C 11/14 |
| 2014/0242863 | A1 * | 8/2014 | Voet | E04B 1/38 442/59 |
| 2015/0023725 | A1 * | 1/2015 | Meuwissen | E01C 11/14 403/28 |
| 2017/0037644 | A1 * | 2/2017 | Gazzotti | E04F 15/02011 |
| 2018/0371703 | A1 * | 12/2018 | Meuwissen | E01C 11/08 |
| 2019/0257040 | A1 * | 8/2019 | Meuwissen | E01C 11/08 |

FOREIGN PATENT DOCUMENTS

| | | | | |
|---|---|---|---|---|
| DE | 202005008762 | U1 | 9/2005 | |
| EP | 2993267 | B1 * | 6/2017 | E01C 11/08 |
| KR | 20090092209 | A | 8/2009 | |

OTHER PUBLICATIONS

International Search Report issued in PCT Patent Application No. PCT/FR2017/051272 dated Jan. 19, 2018.

* cited by examiner

EASILY RENOVATED EXPANSION JOINT FOR A CONCRETE SLAB FORMWORK SYSTEM

TECHNICAL FIELD

The present disclosure concerns the technical domain of shuttering systems for concrete slabs procuring an expansion joint between two adjacent slabs. The disclosure herein more particularly concerns a perfected expansion joint, notably in terms of ease of renovation.

BACKGROUND OF THE DISCLOSURE

In the domain of construction, and notably the domain of coverage of ground with concrete slabs, it is a well-known practice to use a shuttering system incorporating expansion joints between the slabs. In effect, it is commonplace to divide the concrete slab into multiple parts, according to its surface area and its thickness, to create an air space necessary for the absorption of the variations in volume of a slab—under the action of shrinkage, for example.

A known shuttering system generally incorporates an expansion joint including the first and second longitudinal segments, positioned side by side in the same horizontal plane, and with each one being intended to be integral with an upper and horizontal edge of a concrete slab. The first longitudinal segment is rendered integral with a vertical separating plate intended to constitute the vertical boundary between the two adjacent concrete slabs. After a horizontal force of shrinkage of at least one concrete slab, the first and second longitudinal segments are moved apart from each other, with each one remaining integral with the concrete slab of which it forms an integral part.

At the end of their working life, or when these shuttering systems and expansion joints are incorrectly positioned, the opening of the expansion joint after shrinkage of the concrete slab can give rise to shocks or jerk-like stresses that cause damage to the concrete and the longitudinal segments of the said expansion joint.

Also, one single relatively-constraining system for renovating the joint consists in cutting or breaking the concrete with a jackhammer so that one can permanently remove the longitudinal segments of the expansion joint and pour a filler material such as resin or concrete into the void left by the removal of the joints and the broken concrete.

SUMMARY OF THE DISCLOSURE

One of the aims of the disclosed embodiments is therefore to remedy these disadvantages with an expansion joint for a concrete slab shuttering system of which the renovation is simplified when damage has occurred to the longitudinal segments of the joint or the concrete in contact with these segments.

To accomplish this, and to remedy the aforementioned problems, an expansion joint has been developed that is as per the state of the art insofar as it incorporates first and second longitudinal segments, positioned side by side in the same horizontal plane, and with each being intended to be integral with an upper and horizontal edge of a concrete slab, preferably with the first longitudinal segment secured to a vertical separation means, such as a plate.

The first and second longitudinal segments incorporate fittings opening at the upper horizontal walls of the aforementioned first and second longitudinal segments, and allowing the removal of at least part of each of the first and second longitudinal segments, for their replacement.

This way, longitudinal segments that are damaged or improperly positioned can be removed, by acting on the fittings being accessible after the pouring and drying of the concrete slabs, and be replaced. The heavy operations of breaking the concrete and the joints so as to forcibly extract them are eliminated. The renovation is quick and easy.

According to one particular form of implementation, the second longitudinal segment is composed of at least two parts that are secured to each other by a removable means of fixation, so that only the removable part is extracted and replaced during the renovation. The other part remains fixed and anchored in the concrete.

According to particular forms of implementation, to be able to be withdrawn and replaced, the first longitudinal segment is either secured to the vertical separating plate by means of a removable means of fixture, or it is also composed of at least two parts being secured to each other via a removable means of fixation, with one removable upper part and one lower part integral with the separating plate.

Preferably, the vertical plane defined by the separating plate is offset horizontally in relation to the vertical plane defined between the first and second longitudinal segments. Thus, when the concrete slabs shrink, the longitudinal segments move apart from each other but still remain bearing against one of the concrete slabs. The stability of the joint is optimal, and the occurrence of problems such as cracks and breakages is reduced.

Advantageously, the first and second longitudinal segments incorporate complementary means allowing them to nest together horizontally within each other. Thus, the horizontal nesting permits a transfer of vertical loads between the first and second longitudinal segments of the expansion joint.

Preferably, the first longitudinal segment incorporates a stack of three layers of material, with one intermediate layer that is not as wide as the other two layers, so as to have a U-shaped transversal cross-section, while the second longitudinal segment incorporates a stack of three complementary layers of material, with one intermediate layer that is wider than the other two layers, so as to constitute a transverse projection capable of fitting into the hollow of the U-shaped shape of the first longitudinal segment.

According to one particular form of implementation, the fittings take the form of apertures that vertically traverse at least the removable part of each of the first and second longitudinal segments, and rods inserted into the said apertures, with lower extremities being integral with a fixed part of the expansion joint, and with threaded upper extremities able to accommodate tightening devices for the removable securing of the said removable part of each of the first and second longitudinal joints.

Preferably, the removable parts of the first and second longitudinal segments have opposing faces with complementary sinusoidal profiles, so as to provide continuity at the separation between two concrete slabs. Thus, during the passing of a wheeled vehicle, the said wheels remain constantly supported by the surface of one of the adjacent slabs. This feature reduces the shocks and wear inflicted on the concrete slabs in close proximity to the expansion joints.

According to another characteristic, at least the removable part of each of the first and second longitudinal segments is made of a polymer material, or is made of a composite material made from a polymer material, such as a plastic, resin, etc. When the longitudinal segments of the expansion joint have a vertical offset, giving rise to impacts and jerk-like stresses during the passing of vehicles, this feature enables the said longitudinal segments to be abraded to attain an optimal flatness. The renovation is very quick and simply consists of an abrading step.

Obviously, the abradable nature of the longitudinal segments is independent of the removable nature, so one could envision developing an expansion joint being remarkable in that it incorporates first and second longitudinal segments made of a polymer material, or made of a composite material made of a polymer material, without their having a removable nature as such.

BRIEF DESCRIPTION OF THE DRAWINGS

Other advantages and characteristics will come better to the fore in the description that follows, covering multiple variants of implementation—which are provided as non-limitative examples—of the expansion joint, with reference to the appended drawings, in which.

DETAILED DESCRIPTION

The described embodiments concern an expansion joint (1) for a shuttering system for concrete slabs that employs at least one vertical separation means between two adjacent concrete slabs, such as a plate, and that is used when necessary, for the pouring of the concrete, to divide the concrete slab into multiple parts, according to its surface area and its thickness, to create an air space necessary for the absorption of variations in the volume of a slab—under the action of shrinkage, for example.

Figure 1:
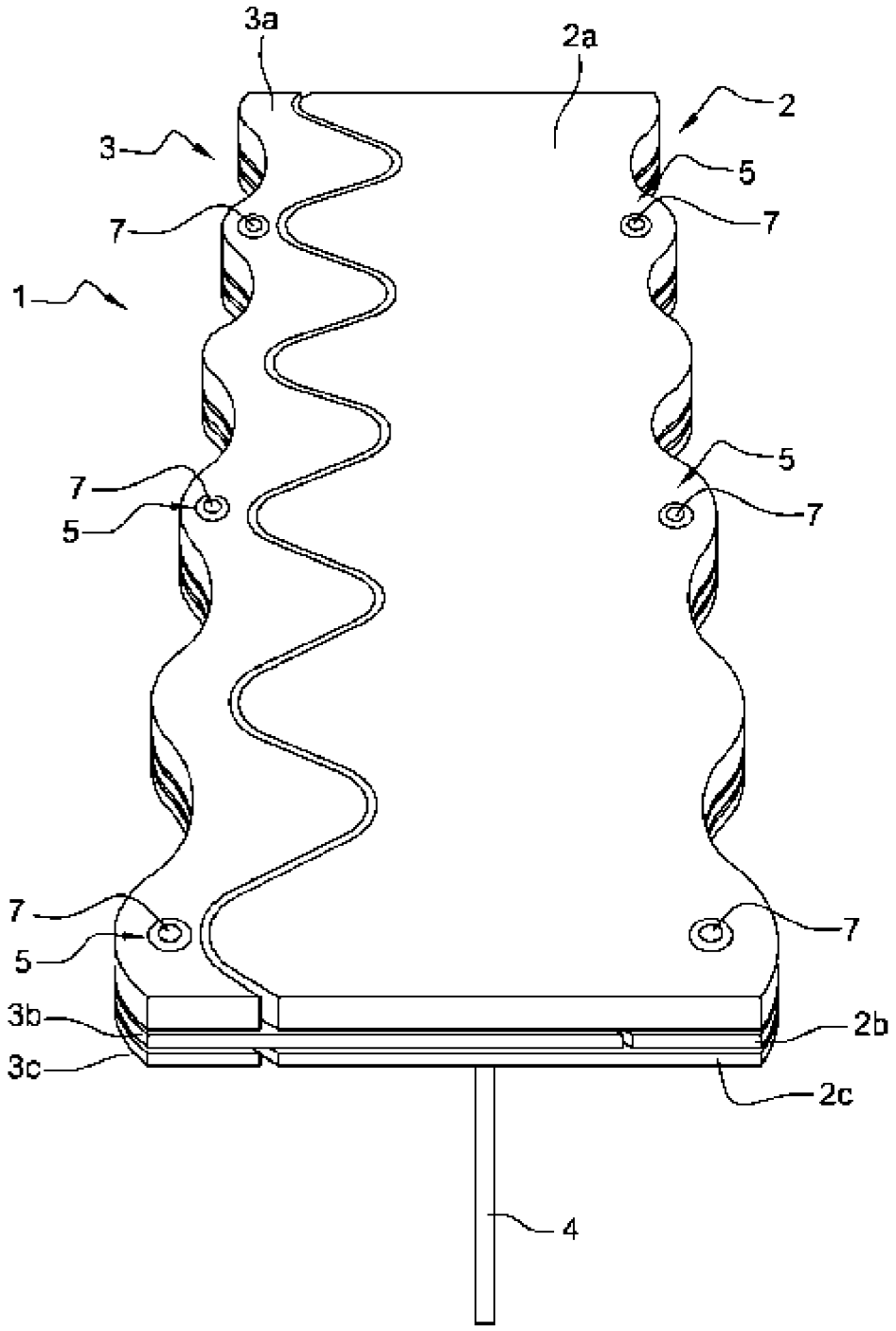
FIG. 1 is an in-perspective view illustrating one form of implementation of the expansion joint, before shrinkage of the concrete slabs.
Figure 2:
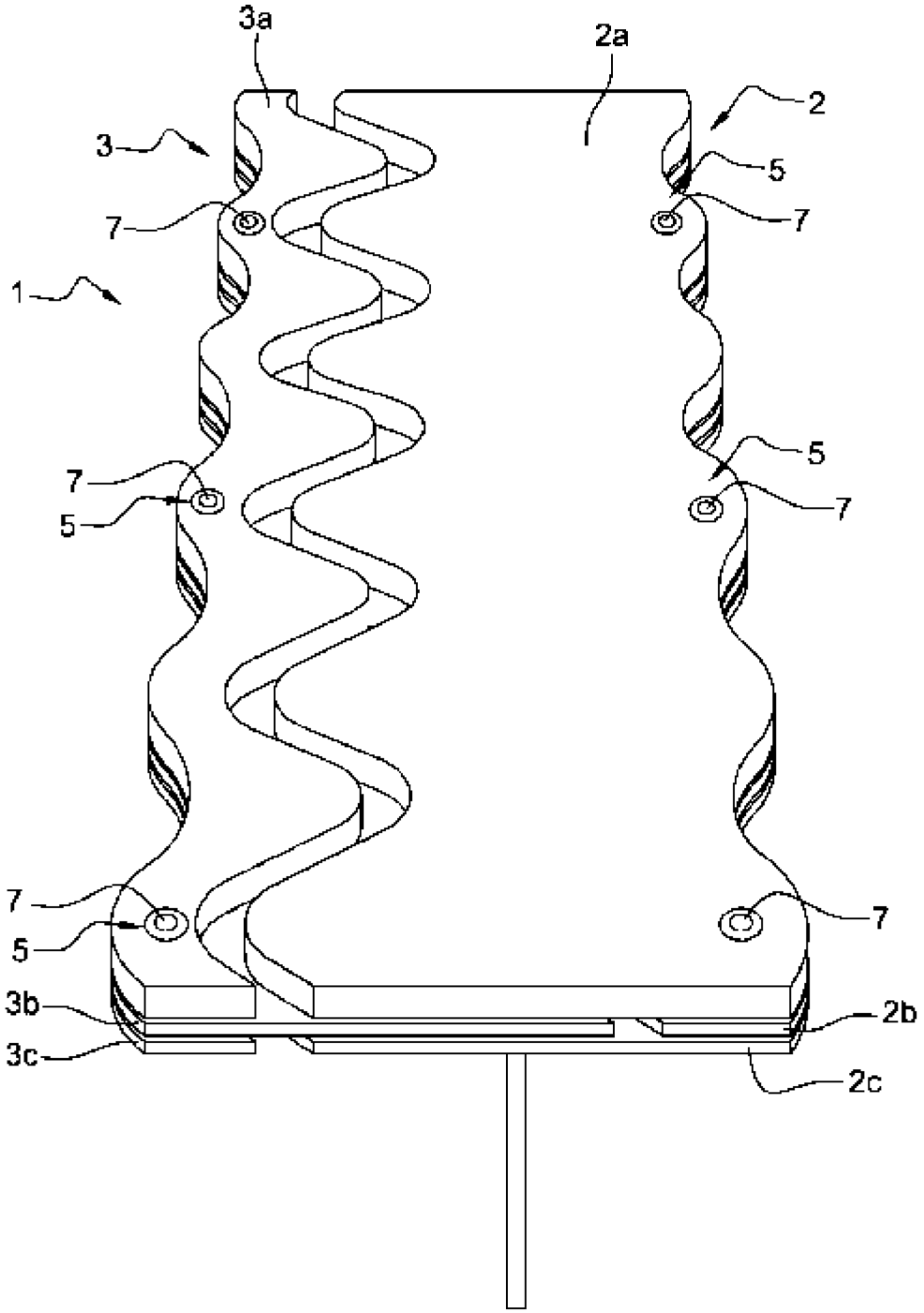
FIG. 2 is an in-perspective view similar to that in FIG. 1, after shrinkage of the concrete slabs.
Figure 3:
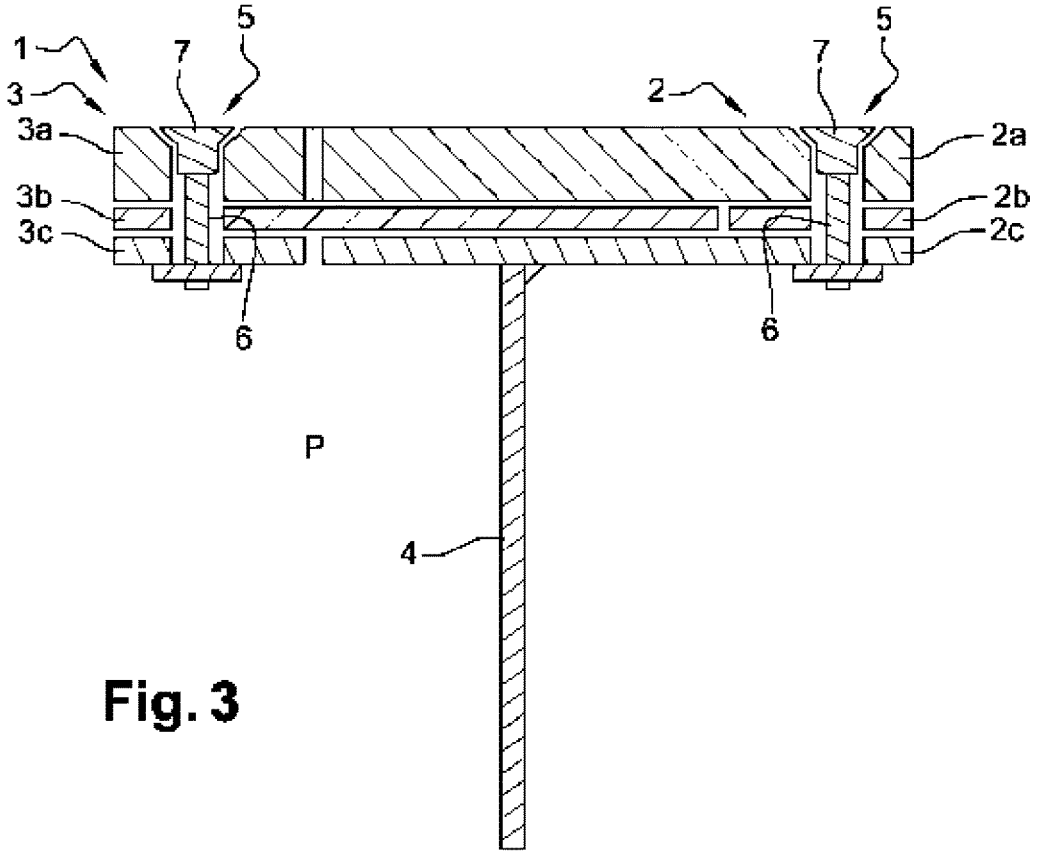
FIG. 3 is a transversal cross-section of the form of implementation of the expansion joint illustrated in FIG. 1, before shrinkage of the concrete slabs.
Figure 4:
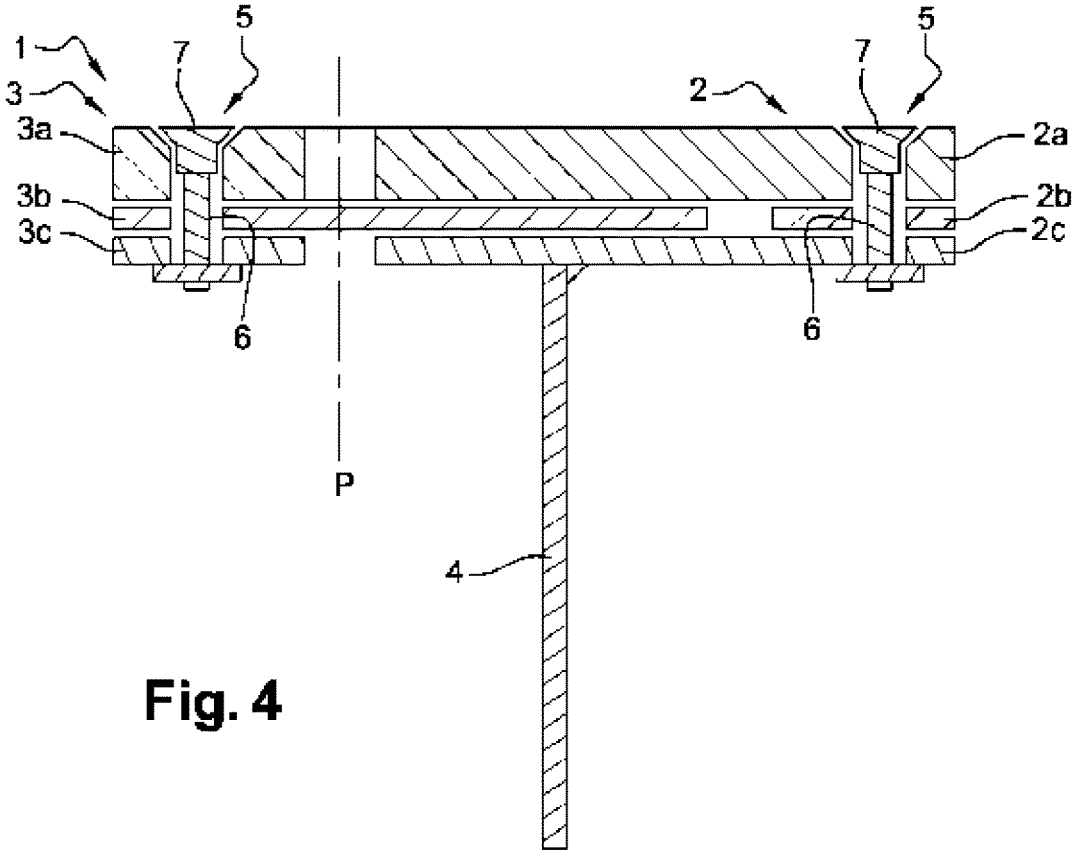
FIG. 4 is a transversal cross-section of the form of implementation of the expansion joint illustrated in FIG. 2, after shrinkage of the concrete slabs.

With reference to FIGS. 1 to 4, the expansion joint (1) incorporates first and second longitudinal segments (2, 3) positioned side by side in the same horizontal plane, being intended to each be integral with an upper and horizontal edge of a concrete slab.

The first longitudinal segment (2) is preferably attached to a vertical separation means (4) between two adjacent slabs, for example a plate. The vertical separation means can be directly fixed, for example welded, under the first longitudinal segment, or the first longitudinal segment (2) can be placed on a vertical separation means already disposed between the two slabs The first and second longitudinal segments (2, 3) can be made of metal or of another material appropriate for abrading, such as a polymer or a composite material made from a polymer—a plastic or resin, for instance.

Thus, when the expansion joint is damaged or improperly positioned, and when the longitudinal segments (2, 3) that form the upper edges of the slabs are vertically offset, shocks and jerk-like stresses occur during the passing of wheeled vehicles, giving rise to problems in the concrete and an accelerated degradation of the concrete and of the expansion joint (1).

The abradable nature of the longitudinal segments (2, 3) enables the longitudinal segments (2, 3) to be levelled via an abrading operation, thereby procuring an optimal flatness of the expansion joint (1) and the concrete slabs. Therefore, the renovation of the expansion joint (1) is facilitated.

The disclosed embodiments also allow one to remedy this problem through the following characteristics, considered individually or in combination with the abradable nature of the longitudinal segments (2, 3), according to which the said longitudinal segments (2, 3) incorporate fittings opening at the upper horizontal walls of the aforementioned first and second longitudinal segments (2, 3), and enable the removal of at least one part (2*a*, 3*a*) of each of the first and second longitudinal segments (2, 3), for their replacement.

According to one embodiment, the first longitudinal segment (2) incorporates a stack of three layers of material, namely one upper layer (2*a*), one intermediate layer (2*b*) and one lower layer (2*c*). The intermediate layer (2*b*) has a smaller width than the upper (2*a*) and lower (2*c*) layers, such that the first longitudinal segment (2) has a U-shaped transversal cross-section.

Similarly, the second longitudinal segment (3) incorporates a stack of three layers of complementary material, namely one upper layer (3*a*), one intermediate layer (3*b*), and one lower layer (3*c*), of which the width is greater than that of the upper (3*a*) and lower (3*c*) layers, such as to form a transverse projection capable of fitting into the hollow of the U-shaped shape of the first longitudinal segment (2) and permits the transfer of vertical loads.

The upper layers (2*a*) and (3*a*) may each include a surface layer of a polymeric material as mentioned.

The first and second longitudinal segments (2, 3) incorporate apertures (5) within their thickness, so as to vertically traverse all of the three layers (2*a*, 2*b*, 2*c*, 3*a*, 3*b*, 3*c*). These apertures (5) are able to accommodate the insertion of rods (6) secured to their lower extremities at fixed parts of the expansion joint (1). For example, the lower extremities of the rods (6) are welded to the lower layers (2*c*, 3*c*) of the first and second longitudinal segments (2, 3). Thee lower extremities of the rods (6) can also be secured to fixed parts of the shuttering system on which the expansion joint is mounted, without falling outside the scope of the disclosure. The upper extremities of the rods (6) are not salient from the first layers (2*a*, 3*a*) of the first and second longitudinal segments (2, 3) and are, for example, threaded so as to interoperate tightening devices (7) that secure the positioning of at least the upper layers (2*a*, 3*a*) of the first and second longitudinal segments (2, 3). Conversely, when these tightening devices (7) are unscrewed, the upper layers (2*a*, 3*a*) of the aforesaid first and second longitudinal segments (2, 3) can be extracted and replaced, notably when they are degraded or when a vertical offset giving rise to shocks and jerk-like stresses is encountered during the passing of a vehicle. Of course, the threaded rods (6) can be replaced by threaded bushes to cooperate with threaded clamping units (7) without leaving the scope of the disclosure.

The width of the upper layer (2*a*) of the first longitudinal segment (2) is greater than the width of the upper layer (3*a*) of the second longitudinal segment (3), and the lower layer (2*c*) of the first longitudinal segment (2) is rendered integral with the vertical separating plate (4)—by welding, for example—such that the vertical plane defined by the separating plate (4) is offset horizontally in relation to the vertical plane (P) defined between the first and second longitudinal segments (2, 3). Thus, with reference to FIGS. 2 and 4, when the concrete slabs shrink, the longitudinal segments (2, 3) move apart from each other but still remain bearing against one of the concrete slabs. The stability of the joint is optimal and the occurrence of problems such as cracks or breakages is reduced.

Therefore, the disclosure concerns an expansion joint (1) incorporating first and second longitudinal segments (2, 3), with each having removable parts, notably constituted by the upper layers (2*a*, 3*a*).

Other forms of implementation can be devised without falling outside the scope of the disclosed embodiments. For example, the intermediate layers (2*b*, 3*b*) and lower layers (2*c*, 3*c*) of the first and second longitudinal segments (2, 3) can form a one-piece ensemble, or else the first longitudinal segment (2) can be made as one piece fixed directly, but in a removable manner, via the same means as explained previously, onto the vertical separating plate (4), which is endowed—for example—with a bracket-like upper edge.

Thus, to ensure continuity at the separation between the two concrete slabs, the removable parts of the first and second longitudinal segments (2, 3)—notably the upper layers (2*a*, 3*a*)—have opposing faces with complementary sinusoidal profiles. Thus, during the passing of a vehicle, the wheels remain constantly supported by the surface of one of the adjacent slabs. This feature reduces shocks and wear inflicted on concrete slabs in close proximity to expansion joints.

The invention claimed is:

1. An expansion joint configured for placement between first and second concrete slabs positioned adjacent thereto, the expansion joint defining an air space that absorbs variations in volume of the first and second concrete slabs under an action of shrinkage, said joint incorporating first and second longitudinal segments positioned side by side in a same horizontal plane, and being configured to each be integral with an upper and horizontal edge of the first and second concrete slabs, the first longitudinal segment being secured to a vertical separation means between the first and second concrete slabs defining a vertical plane horizontally offset with respect to a vertical plane defined between the first and second longitudinal segments such that under the action of shrinkage of the first and second concrete slabs, the first and second longitudinal segments move apart from each other but still remain bearing against one of the first and second concrete slabs, the first and second longitudinal segments comprise fittings opening at upper horizontal walls of said first and second longitudinal segments, and that enable a removal of at least a removable part of each of the first and second longitudinal segments, for replacement of said removable parts; wherein the first longitudinal segment comprises a stack of three layers of material, with one intermediate layer having a smaller width than the other two layers, such that the first longitudinal segment has a U-shaped cross section, and the second longitudinal segment comprises a stack of three complementary layers of material, with one intermediate layer having a greater width than the other two layers, so as to form a transverse projection configured to fit into the hollow of the U-shaped shape of the first longitudinal segment.

2. An expansion joint according to claim 1, wherein the fittings take the form of apertures vertically traversing at least the removable part of each of the first and second longitudinal segments and rods inserted into the said apertures, with lower extremities integral with a fixed part of the expansion joint and threaded upper extremities able to accommodate tightening devices, for the removable fixation of the said removable part of each of the first and second longitudinal segments.

3. An expansion joint according to claim 1, wherein the removable parts of the first and second longitudinal segments have opposing faces incorporating complementary sinusoidal profiles.

4. An expansion joint according to claim 1, wherein at least the removable part of each of the first and second longitudinal segments is made of a polymer material, or of a composite material made from a polymer material.

5. An expansion joint according to claim 1, wherein the second longitudinal segment is composed of at least two parts secured to each other via a removable means of fixation.

6. An expansion joint according to claim 5, wherein the first longitudinal segment is secured to the vertical separation means via a removable means of fixation.

7. An expansion joint according to claim 5, wherein the first longitudinal segment is composed of at least two parts secured to each other via removable means of fixation.

* * * * *